US008621671B1

(12) United States Patent
Schiebl

(10) Patent No.: US 8,621,671 B1
(45) Date of Patent: Jan. 7, 2014

(54) PROTECTIVE CHIN GUARD

(76) Inventor: Paul Schiebl, Houston, TX (US)

( * ) Notice: Subject to any disclaimer, the term of this patent is extended or adjusted under 35 U.S.C. 154(b) by 238 days.

(21) Appl. No.: 13/190,045

(22) Filed: Jul. 25, 2011

Related U.S. Application Data

(63) Continuation-in-part of application No. 11/752,100, filed on May 22, 2007, now Pat. No. 8,006,322, which is a continuation-in-part of application No. 11/222,283, filed on Sep. 8, 2005, now Pat. No. 7,735,160, which is a continuation-in-part of application No. 10/463,774, filed on Jun. 16, 2003, now abandoned.

(51) Int. Cl.
*A42B 7/00* (2006.01)

(52) U.S. Cl.
USPC ..... 2/421

(58) Field of Classification Search
USPC ..... 2/421, 410, 411, 414, 417, 418, 422, 2/425, 9, 455
See application file for complete search history.

(56) References Cited

U.S. PATENT DOCUMENTS

| | | | | |
|---|---|---|---|---|
| 3,619,813 | A * | 11/1971 | Marchello | 2/421 |
| 3,916,446 | A * | 11/1975 | Gooding | 2/421 |
| 5,794,274 | A * | 8/1998 | Kraemer | 2/421 |
| 6,298,483 | B1 | 10/2001 | Schiebl et al. | |
| 6,481,024 | B1 * | 11/2002 | Grant | 2/421 |
| 6,499,147 | B2 | 12/2002 | Schiebl et al. | |
| 7,886,370 | B2 * | 2/2011 | Winningham | 2/421 |

* cited by examiner

*Primary Examiner* — Tejash Patel
(74) *Attorney, Agent, or Firm* — Egbert Law Offices, PLLC

(57) ABSTRACT

A chin guard has a shell with a cup suitable for fitting upon a human chin and a resilient layer received within the cup of the shell. The resilient layer is suitable for contacting the human chin. The shell has a first strap-receiving slot on one side thereof and a second strap-receiving slot on an opposite side thereof. Each of the first and second strap-receiving slots open through a thickness of the shell. A first strap extends through the first strap-receiving slot and a second strap extends through said second strap-receiving slot. The first and second slots are arranged transverse to a longitudinal axis of the shell.

18 Claims, 4 Drawing Sheets

PROTECTIVE CHIN GUARD

CROSS-REFERENCE TO RELATED U.S. APPLICATIONS

The present invention is a continuation-in-part of U.S. application Ser. No. 11/752,100, filed on May 22, 2007, and entitled "Padded Chin Guard", presently pending. U.S. application Ser. No. 11/752,100 is a continuation-in-part of U.S. application Ser. No. 11/222,283, filed on Sep. 8, 2005 and entitled "Chin Guard Apparatus for use with a Helmet", issued as U.S. Pat. No. 7,735,160 on Jun. 15, 2010. U.S. application Ser. No. 11/222,283 is a continuation-in-part of U.S. patent application Ser. No. 10/463,774, filed on Jun. 16, 2003, and entitled "Helmet Chinstrap", now abandoned.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to chin guards for use with helmets. More particularly, the present invention relates to chin guards that have protective cups associated therewith for protection of the chin of the wearer. More particularly, the present invention relates to chin guards apparatus that have at least one resilient layer extending across an interior surface of the protective cup.

2. Description of Related Art

Including Information Disclosed Under 37 CFR 1.97 and 37 CFR 1.98.

The invention relates to improvements in protective headgear such as football helmets, lacrosse helmets, hockey helmets, bull riding helmets, motorcycle and bicycle helmets, and helmets for other activities where protection from head impact and injury is desirable. The invention also relates to protective pads, particularly chin pads.

Protective helmets to minimize head injuries have been known and used for many years. For example, football helmet shells have been produced from injection molded ABS, or polycarbonate plastic. Helmets intended for youth usage have usually been produced from ABS plastic, and helmets for adult usage have usually been produced from polycarbonate plastic. ABS plastic is significantly less expensive than polycarbonate, but ABS plastic is not as structurally rigid as polycarbonate. As the level of intensity of contact in youth football is significantly lower than that at the adult level, ABS has been accepted as a satisfactory material for use at the youth level. For adult helmets, however, the structural rigidity of the polycarbonate material is essential to minimize the flex and deformation of the shell under extreme impact conditions.

The National Operating Committee on Standards for Athletic Equipment (NOCSAE) has been responsible for setting minimal performance criteria for football helmets. The minimum standard acceptance level measured by the Severity Index (IS) is set at 1200. Through the continuous testing of NOCSAE, it has been established that the rigidity of polycarbonate shells, in comparison to ABS shells, leads to significantly lower IS results. From these tests, it is believed that there is a correlation between the rigidity of the shell material and improved safety performance.

Protection can also be improved by the addition of a face mask attached to the helmet. For example, football helmets are usually equipped over the exposed face area with a vinyl coated wire or other metal structure, or an injection molded plastic face mask. The obvious purpose of the face mask is to protect the face of the player from injury, while not obstructing the player's vision unnecessarily. The addition of a face mask can also increase the rigidity of the shell which improves the IS performance. Helmets are usually tested without face masks so that the IS performance of a helmet with the mask will somewhat exceed the test standard.

Face masks have been mounted to the exterior surface of the helmet shell behind the front edge of the helmet face opening. This design can, under certain conditions, contribute to serious injury. Helmet shells are specifically designed with smooth spherical surfaces to allow the shells to glance and slide on impact.

Protective helmets usually include a chin strap to retain the helmet, particularly during impact. In the past, chin straps were frequently constructed using a molded plastic cup made of compression or injection-molded plastic material. A pad, usually of a felt or foam material, was bonded or otherwise attached to the plastic cup. This cup construction is preferable to non-padded chin straps which have been standard equipment on football helmets. Non-padded chin straps do not offer any impact protection to the chin area, and only serve to secure the helmet to the player's head. Padded chin cups provide an added measure of protection to the chin from impacts, in addition to securing the helmet to the player's head.

Improvement in the impact absorption performance of padded chin straps is desirable. Most molded plastic chin cups currently used are molded in a manner which allows the formed cup to flex upon impact. An improved construction is a rigid material which does not flex on impact to an undesirable degree, thus distributing the impact force over a larger area of the chin.

The present inventor is the owner of U.S. Pat. No. 6,298,493, issued on Oct. 1, 2001 to Schiebl et al. U.S. Pat. No. 6,298,493 describes a protective headgear that comprises a rigid shell with face pads that can be released and removed while the headgear is still on a person's head. A protective chin guard is attached to the headgear by way of the face pads. The chin guard includes a substantially rigid shell with an insert made of a flexible bladder filled with a shock-absorbing fluid. The headgear includes a shell made of an inner and outer material layered over an internal foam core to effect both strength and lightweight construction.

The cup associated with the protective shell of the chin strap often has had an imperfect fit with the wearer's chin. In certain circumstances, the user may desire to have enhanced protection against impacts. The wearer may also desire a more comfortable fit with the cup of the shell of the protective chin strap and more comfortable contact between the chin and an interior surface of the chin guard.

In prior art chin straps, there is often an inferior connection between the actual chin guard and the straps. In order to achieve maximum integrity, it is important for the straps to be securely connected to the chin guard. If the strap should become disconnected or torn from the chin guard, then inadequate protection of the person wearing the chin guard will result. Additionally, many connecting structures between the straps in the chin guard involve a rather complicated looping of straps through multiple slots formed on the chin guard. This can create an unattractive appearance and an inadequate fit. As such, a need has developed so as to provide a chin guard wherein the straps can be easily and adjustably connected to the chin guard in a secure and stable manner.

It is an object of the present invention to provide a chin guard apparatus which maximizes the protection and comfort of the user.

It is a further object of the present invention to provide a chin guard apparatus whereby the cushion of the cup can be adapted to properly fit the facial configuration and desires of the user.

It is another object of the present invention to provide a chin guard apparatus that enhances shock absorption.

It is another object of the present invention to provide a chin guard which allows the straps to be easily and securely connected thereto.

It is a further object of the present invention to provide a chin guard whereby the straps of the chin guard are more securely retained by the chin guard.

It is still another object of the present invention to provide a chin guard which avoids unnecessary looping and buckling of the straps to the chin guard.

It is another object of the present invention to provide a chin guard apparatus that is relatively inexpensive, easy to manufacture and easy to assemble.

These and other objects and advantages of the present invention will become apparent from a reading of the attached specification and appended claims.

BRIEF SUMMARY OF THE INVENTION

The present invention is a chin guard apparatus for use with a helmet. The chin guard has a shell with a cup suitable for fitting upon a human chin. The shell has a first strap-receiving slot on one side thereof and a second strap-receiving slot on an opposite side thereof. Each of the first and second strap-receiving slots open through a thickness of the shell. A resilient layer is received within the cup of the shell. This resilient layer is suitable for contacting the human chin In the preferred embodiment of the present invention, each of the first and second strap-receiving slots extend transverse to a longitudinal axis of the shell. The first strap-receiving slot is a single slot on the one side of the shell. The second strap-receiving slot is a single slot on the opposite side of the shell.

The resilient layer is in surface-to-surface contact with an inner surface of the shell. The resilient layer has a padded section formed centrally on a side of the resilient layer opposite the shell.

In one embodiment of the present invention, the resilient layer is of a foam material. In other embodiments of the present invention, the resilient layer can be of a fabric, rubber, elastomeric, silicone or other soft materials.

A first strap extends through the first strap-receiving slot. A second strap extends through the second strap-receiving slot. Each of the first and second straps has a portion positioned between an inner surface of the resilient layer and an inner surface of shell.

The shell has an outer peripheral edge. The shell also has first channel extending from the first strap-receiving slot to the outer peripheral edge. The first strap has a portion extending along this first channel. The shell further has a second channel extending from second strap-receiving slot to the outer peripheral edge. The second strap has a portion extending along this second channel The single strap-receiving slot on opposite sides of the shell assures a proper and secure connection between the straps and the chin guard. Since the slots are formed through the rigid polymeric material of the shell, the straps are connected to a rigid material rather than a flexible, and possibly tearable, material. The use of the transverse orientation of the slots assures a proper threading of the strap through the shell of the chin guard. The alignment of the strap is assured through the use of the channels associated with each of the slots. The present invention avoids the unnecessary looping and cross-threading associated with other chin guards. As such, the straps can be installed in a quick, easy and secure manner. The strap can have portions that extend outwardly from the shell of the chin guard so as to be secured to the high and low hook-ups of a helmet.

DETAILED DESCRIPTION OF THE INVENTION

Figure 1:
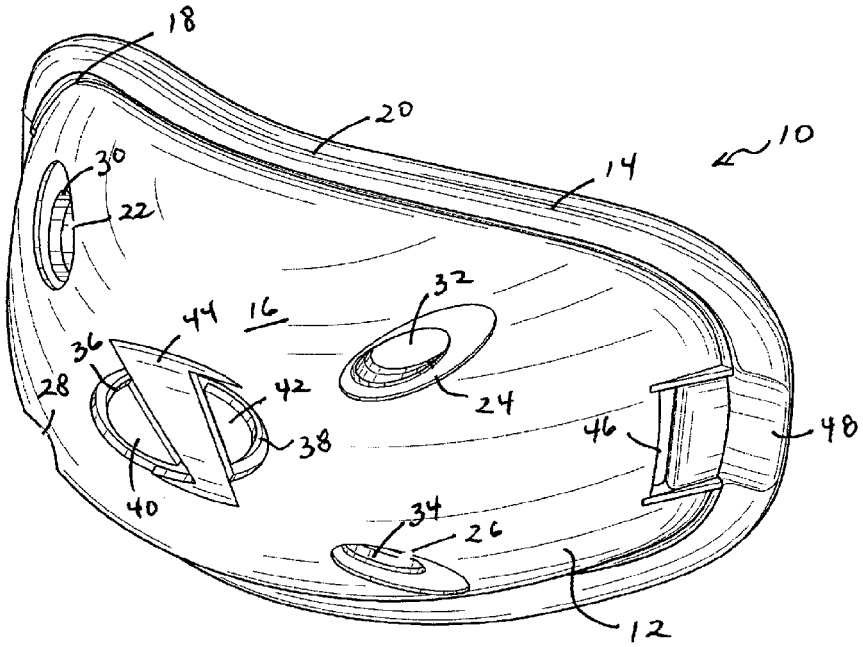
FIG. 1 is a perspective view of the chin guard in accordance with the preferred embodiment of the present invention.

Referring to FIG. 1, there is shown the chin guard 10 in accordance with the preferred embodiment of the present invention. The chin guard 10 includes a shell 12 and a resilient layer 14. The shell 12 has a cup 16 suitable for fitting upon a human chin. The shell has an outer peripheral edge 18 that extends therearound and extends outwardly of the outer periphery of the cup 16. The resilient layer 14 is received within the cup 16 of shell 12. The resilient layer 14 has a periphery 20 which overlies the outer peripheral edge 18 of the shell 12.

As can be seen in FIG. 1, the shell 12 is formed of a rigid polymeric material. Holes 22, 24, 26 and 28 are formed through the shell 12 so as to allow air circulation to contact the chin of the user. Similarly, as will be described hereinafter, the resilient layer 14 also includes holes 30, 32 and 34 which are aligned with the through holes 22, 24 and 26, respectively, of the shell 12. This arrangement of aligned holes ensures proper air circulation to the chin of the wearer.

The shell 12 also includes a first generally semi-circular opening 36 and a second semi-circular opening 38 formed centrally of the cup 16. The semi-circular openings 36 and 38 will receive semi-circular shaped insert members 40 and 42, respectively, of the resilient layer 14. A bumper member 44 is received between the semi-circular openings 36 and 38 so as to extend thereacross. Bumper member 44 can provide shock absorbency at the very center of the shell 12. The bumper member 44 can be formed of various materials.

The shell 12 includes a slot 46 formed on one side and another slot formed on the opposite side. The slot 46 is suitable for receiving the strap which serves to connect the chin guard 10 to a helmet. A suitable channel 48 can be formed on the resilient member 14 generally adjacent to the slot 46 so as to provide a suitable guide for the chin strap extending thereacross.

The shell 12 is formed of a rigid polymeric material while the resilient layer 14 is formed of a foam or other soft material. Since there are only two main components of the chin guard 10 of the present invention, the chin guard 10 can be assembled in an easy manner. Additionally, the manufacturing costs associated with forming the chin guard 10 of the present invention are minimal. These goals can be accomplished while, at the same time, providing maximum protection to the wearer of the chin guard. Since the resilient layer 14 overlies the outer peripheral edge 18 of the shell 12, sharp contacts between the outer peripheral edge 18 of the shell 12 and the face of the wearer are effectively cushioned.

Figure 2:
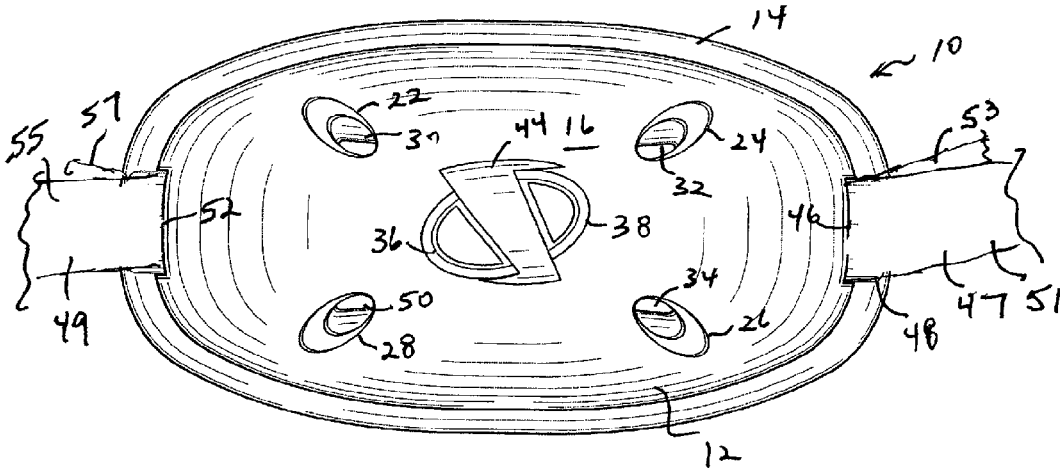
FIG. 2 is a frontal view of the chin guard of the present invention.

FIG. 2 shows a front view of the chin guard 10 of the present invention. In FIG. 2, the holes 22, 24, 26 and 28 are fully illustrated. Each of these holes 22, 24, 26 and 28 has a generally oval or oblong configuration. The respective holes 30, 32, 34 and 50 of the resilient layer 14 are illustrated as aligned with the respective holes 22, 24, 26 and 28. The oval nature of the holes 22, 24, 26 and 28 assures full air circulation to the wearer even in the event that the resilient layer 14 has shifted slightly out of position. The semi-circular openings 36 and 38 are illustrated as located within the center of the cup 16 of shell 12. The bumper member 44 has a generally reverse Z-shaped configuration.

In FIG. 2, it can be seen that there is a first strap 47 that extends through the slot 46. Another strap 49 extends through the slot 52. Each of these slots 46 and 52 extends in an orientation generally transverse to a longitudinal axis of the shell 12. It can be seen that there is a single slot 46 on one side of the shell 12 and a single slot 52 on an opposite side of the shell 12. Each of the slots 46 and 52 extends through the thickness of the polymeric material used to form the shell 12. The first strap 47 extends through the slot 46. It can be seen that the strap 47 has a portion 51 that will extend along the channel 48 formed adjacent to the slot 46. As such, the channel 48 will assure the proper alignment of the strap 47. The strap 47 also has another portion 53 that extends outwardly from the backside of the shell 12. This second portion 53 will extend between the inner surface of the shell 12 and the inner surface of the resilient layer 14. Each of the portions 51 and 53 extends outwardly of the shell 12. A suitable mechanism, such as a strap splitter, can be utilized so as to properly align the portions 51 and 53 so that the opposite ends of the strap 47 can be secured to the high or low hook-ups of a football helmet.

The strap-receiving slot 52 is formed on the opposite side of the shell 12 from the strap-receiving slot 46. The strap 49 will extend through the slot 52. As can be seen, the strap 49 has a first portion 55 that will extend along the channel associated with this slot 52. The strap 49 will also have a second portion 57 that will extend between the inner surface of the shell 12 and the inner surface of the resilient layer 14. Each of the portions 55 and 57 can be threaded through a suitable strap splitter, or other mechanism, so as to be secured to the high or low hook-ups of a football helmet.

The orientation of the straps 47 and 49, as shown in FIG. 2, is a significant improvement over the prior art. In the present invention, there are only single slots 46 and 52 provided on opposite sides of the shell 12. As such, it is not necessary to thread and loop the portions of the respective straps 47 and 49 a variety of holes and/or slots. The threading of the strap 47 and 49 through the respective slots 46 and 52 provides a neat appearance in the area of connection between the straps and the chin guard 10. Additionally, since the slots 46 and 52 are formed through the thickness of the rigid polymeric material of the shell 12, there is an absolutely secure and sound fit between the respective straps 47 and 49 and the shell 12. As such, any tearing or ripping of the strap is effectively avoided. The respective channels associated with the slots 46 and 52 will assure the proper alignment of the portion 51 of strap 47 and the portion 55 of strap 49. As such, this can provide an easy guide whereby the straps can be properly secured in a desired location to the helmet.

Figure 3:
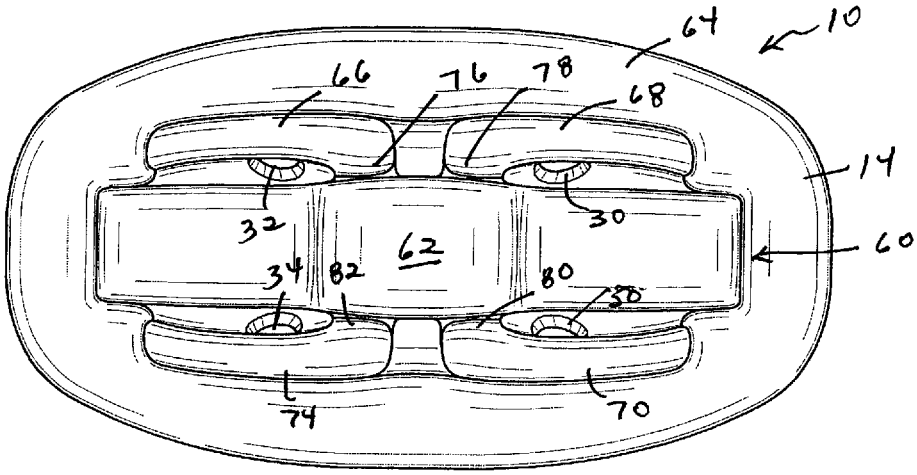
FIG. 3 is a back view of the chin guard of the present invention.

FIG. 3 illustrates the interior of the chin guard 10 of the present invention. In FIG. 3, the resilient layer 14 is particularly illustrated. The resilient layer 14 has padded surfaces 60 formed therein. The padded surfaces 60 include a rectangular portion 62 extending centrally across a support layer 64 of the resilient layer 14. The support layer 64 is positioned so as to be in surface-to-surface contact with the interior surface of the shell 12. The padded surfaces 60 are integrally formed with the support layer 64. Finger members 66, 68, 70 and 74 are also integrally formed with the support layer 64 and extend in generally spaced relationship to the edges of the rectangular portion 62. The finger 66 has an adjoining portion 76 connected to the rectangular portion 62. The finger 68 has an adjoining portion 78 connected to the rectangular portion 62. The finger 70 has an adjoining portion 80 connected to the rectangular portion 62. The finger 74 has an adjoining portion 82 connected to the rectangular portion 62. The adjoining portions 76, 78, 80 and 82 are located in a central area of the rectangular portion 62. The spacing between the fingers 66, 68, 70 and 74 and the rectangular section 62 is intended to accommodate the through holes 30, 32, 34 and 50 which are formed through the support layer 64 are aligned with the respective through holes formed in the shell 12. As such, the arrangement of the various padded surfaces 60 in the resilient layer 14 assures a proper air flow through the through holes to the chin of the wearer.

Figure 4:
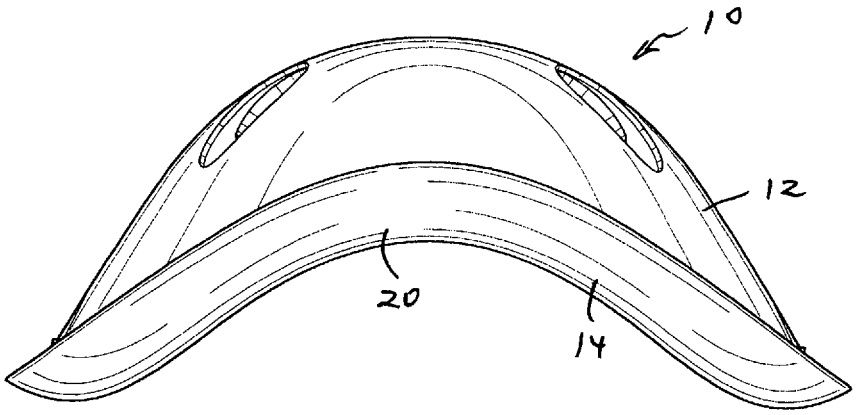
FIG. 4 is a side elevational view of the chin guard of the present invention.

FIG. 4 illustrates a plan view of the chin guard 10 of the present invention. In FIG. 4, it can be seen that the resilient layer 14 has a peripheral surface 20 which overlies and extends rearwardly over the outer peripheral edge 18 of the shell 12. This lengthy overlying relationship assures a protective cushioning effect against any sharp edges of the rigid shell 12.

Figure 5:
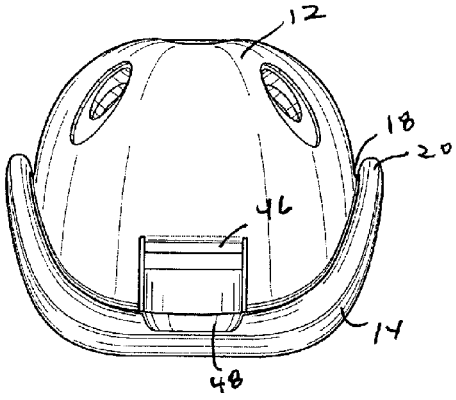
FIG. 5 is an end view of the chin guard of the present invention.

In FIG. 5, the resilient layer 14 is further illustrated as having its outer periphery 20 extending over and beyond the outer peripheral edge 18 of the shell 12 on opposite sides of the shell 12. The channel 48 is illustrated as formed in a surface of the outer periphery 20 of the resilient layer 14 so as to generally align with the slot 46 formed in the shell 12.

Figure 6:
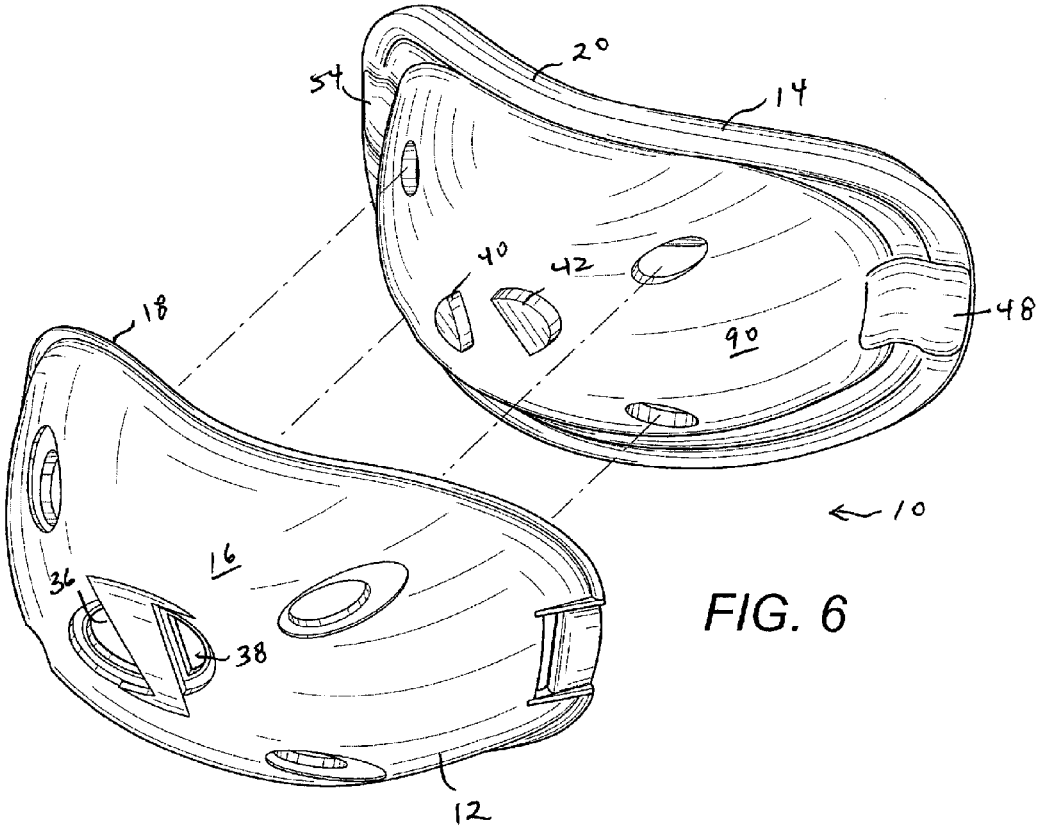
FIG. 6 is an upper perspective exploded view of the chin guard of the present invention.

FIG. 6 illustrates the manner in which the resilient layer 14 is received within the shell 12 of the chin guard 10 of the present invention. In FIG. 6, the shell 12 has cup 16 which serves to receive the cup area 90 of the resilient layer 14. The semi-circular insert members 40 and 42 are positioned so as to be received by the semi-circular indentations 36 and 38 located centrally on the shell 12. This arrangement serves to retain the resilient layer 14 removably within the interior of the cup 16 of the shell 12. FIG. 6 shows that the through holes of the resilient layer 14 are aligned with the through holes of the shell 12 when the insert members 40 and 42 are received within the semi-circular openings 36 and 38 of the shell 12. The shell 12 is illustrated as having its outer peripheral edge 18 slighted flanged outwardly of the shell 12. The outer peripheral edge 20 has a suitable size so as to completely cover this outer peripheral edge 18 and to provide effective protection against sharp impacts caused by the outer peripheral edge 18 against the face of the wearer. The resilient layer 14 is illustrated as having a channels 48 and 54 formed on opposite sides thereof so as to align with the strap-receiving slots formed on the shell 12. These surfaces provide a guide for the strap which emanates through the slots on the shell 12.

Figure 7:
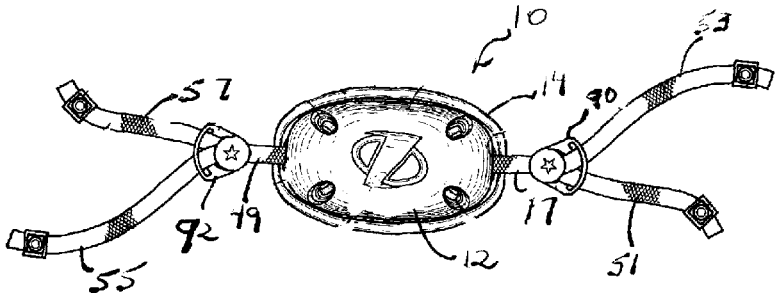
FIG. 7 is a frontal view of the chin guard of the present invention showing, in particular, the mechanism for assuring a divergent relationship of the straps.

FIG. 7 shows he strap splitters 90 and 92 which assure the divergent relationships of the respective straps 47 and 49. In particular, strap 47 extends from the slot in the shell 12 and has the strap splitter 90 extending thereover. Strap splitter 90 has slots formed therein which causes the portions 51 and 53 to extend in different direction away from each other. Similarly, strap splitter 92 has slots formed therein which cause the portions 55 and 57 to extend in different directions away from each other. As a result of the strap splitters 90 and 92, the respective portions can be properly directed to the high and/or low hook-ups of the helmet. In the strap splitters 90 and 92, the respective straps 47 and 49 will enter generally aligned with each other and then diverge at the opposite end of the strap splitters.

Figure 8:
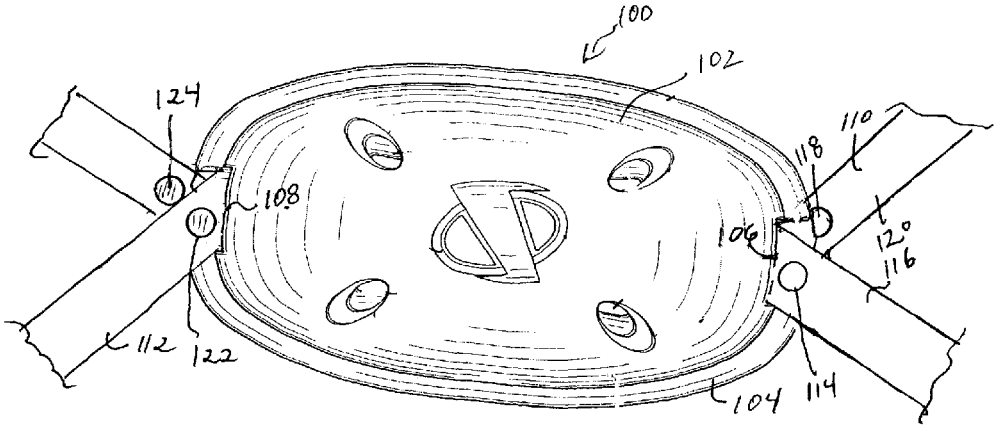
FIG. 8 is a frontal view of an alternative embodiment of the present invention.

FIG. 8 shows an alternative embodiment of the present invention. In FIG. 8, the chin guard assembly 100 has a shell 102 and a resilient layer 104. The shell 102 and the resilient layer 104 have a configuration similar to the previous embodiment. The shell has a first strap-receiving slot 106 and a second strap-receiving slot 108. A first strap 110 extends through the first strap-receiving slot 106. A second strap 112 extends through the second strap-receiving slot 108.

Unlike the strap splitters 90 and 92 in FIG. 7, the embodiment of FIG. 8 utilizes stops in order to allow the position of the straps 110 and 112 to be adjustably fixed. In particular, strap 110 has a first rivet 114 affixed to a first portion 116 adjacent to one side of the strap-receiving slot 106. Strap 110 has a second rivet 118 affixed to a second portion 120 adjacent to an opposite of the strap-receiving slot 106. Similarly, the strap 112 has a first rivet 122 adjacent one side of strap-receiving slot 108 and a second rivet 124 adjacent to an opposite side of the strap-receiving slot 108. The rivets 114, 118, 122 and 124 extend outwardly of a surface of the respective straps so as to have a thickness greater than the width of the respective strap-receiving slots 106 and 108. As such, the rivets act as stops so as to prevent excessive movement of the shell 102 relative to the straps 110 and 112.

The use of the rivets (or stops) unexpectedly facilitates the ability to angularly adjust the straps 110 and 112 relative to the high and low hook-ups of the helmet. The rivets can be conveniently installed subsequent to the connection of the shell 102 with the straps 110 and 112. As such, the length of the straps can be widely adjustable to the preferences of the user. The number of separable components is significantly reduced. Additionally, the costs associated with the rivets is minimal. In certain helmets with broadly extending face masks, the rivets will not interfere with such face masks.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A chin guard comprising:

a shell having a cup suitable for fitting upon a human chin, said shell having a first strap-receiving slot on one side thereof and a second strap-receiving slot on an opposite side thereof, each of said first and second strap-receiving slots opening through a thickness of said shell; and a resilient layer received within said cup of said shell, said resilient layer suitable for contacting the human chin;

a first strap extending through said first strap-receiving slot; and a second strap extending through said second strap-receiving slot, said shell having an outer peripheral edge, said shell having a first channel extending from said first strap-receiving slot to said outer peripheral edge, said first strap having a portion extending along said first channel, said shell having a second channel extending from second strap-receiving slot to said outer peripheral edge, said second strap having a portion extending along said second channel.

2. The chin guard of claim 1, each said first and second strap-receiving slots extending transverse to a longitudinal axis of said shell.

3. The chin guard of claim 1, said first strap-receiving slot being a single slot on said one side, said second strap-receiving slot being a single slot on said opposite side.

4. The chin guard of claim 1, said resilient layer being in surface-to-surface contact with an inner surface of said shell.

5. The chin guard of claim 4, said resilient layer having a padded section formed centrally on a side of or within said resilient layer opposite said shell.

6. The chin guard of claim 1, said first and second straps each having a portion positioned between a surface of said resilient layer and an inner surface of shell.

7. A chin guard comprising:

a shell having a cup suitable for fitting upon a human chin, said shell having a first strap-receiving slot on one side thereof and a second strap-receiving slot on an opposite side thereof, each of said first and second strap-receiving slots opening through a thickness of said shell; and a resilient layer received within said cup of said shell, said resilient layer suitable for contacting the human chin;

a first strap splitter extending over said first strap so as to cause portions of said first strap to diverge away from each other; and a second strap splitter extending over said second strap so as to cause portions of said second strap to diverge away from each other.

8. The chin guard of claim 7, each of first and second strap splitters having a first slot into which the strap enters and at least one second slot through which the strap exits.

9. The chin guard of claim 7, further comprising:

a first stop affixed to said first strap adjacent said first strap-receiving slot; and a second stop affixed to said second strap adjacent said second strap-receiving slot.

10. A chin guard comprising:

a shell having a cup suitable for fitting upon a human chin, said shell have a first slot on one side thereof and a second slot on an opposite side thereof, said first and second slots opening through a thickness of said shell;

a resilient layer received within said cup of said shell, said resilient layer suitable for contacting the human chin;

a first strap extending through said first slot; and a second strap extending through said second slot;

a first strap splitter extending over said first strap so as to cause portions of said first strap to diverge away from each other; and a second strap splitter extending over said second strap so as to cause portions of said second strap to diverge away from each other.

11. The chin guard of claim 10, each of said first and second slots extending transverse to a longitudinal axis of said shell.

12. The chin guard of claim 10, said first slot being a single slot on said one side, said second slot being a single slot on said opposite side.

13. The chin guard of claim 10, said resilient layer being in surface-to-surface contact with an inner surface of said shell.

14. The chin guard of claim 13, said resilient layer having a padded section formed centrally on a side of or within said resilient layer opposite said shell.

15. The chin guard of claim 10, each of said first and second straps each having a portion positioned between a surface of said resilient layer and an inner surface of said shell.

16. The chin guard of claim 10, said shell having an outer peripheral edge, said shell having a channel extending from said slot to said outer peripheral edge, said first strap having a portion extending along said first channel, said shell having a second channel extending from said second strap-receiving slot to said outer peripheral edge, said second strap having a portion extending along said second channel.

17. The chin guard of claim 10, each of first and second strap splitters having a first slot into which the strap enters said at least one second slot through which the strap exits.

18. A chin guard comprising:

a shell having a cup suitable for fitting upon a human chin, said shell having a first strap-receiving slot on one side thereof and a second strap-receiving slot on opposite side thereof;

a resilient layer received within said cup of said shell, said resilient layer suitable for contacting the human chin;

a first strap extending through said first strap-receiving slot;

a second strap extends through said second strap-receiving slot;

a first stop affixed to said first strap adjacent to said first strap-receiving slot; and a second stop affixed to said second strap adjacent to said second strap-receiving slot, said first stop comprising a first rivet affixed to said first strap on one side of said first strap-receiving slot and a second rivet affixed to said first strap on an opposite side of said first strap-receiving slot, said second stop comprising a third rivet affixed to said second strap adjacent one side of said second strap-receiving slot and a fourth rivet affixed to said strap on an opposite side of said second strap-receiving slot.

* * * * *